US006616199B1

(12) United States Patent
Tokach et al.

(10) Patent No.: US 6,616,199 B1
(45) Date of Patent: Sep. 9, 2003

(54) TWO STAGE LATCH FOR HEAVY DUTY ENGINE COVER

(75) Inventors: Thomas Tokach, Mandan, ND (US); Troy D. Kraft, Wahpeton, ND (US); Daniel J. Krieger, Bismarck, ND (US)

(73) Assignee: Bobcat Company, Woodcliff Lake, NJ (US)

( * ) Notice: Subject to any disclaimer, the term of this patent is extended or adjusted under 35 U.S.C. 154(b) by 0 days.

(21) Appl. No.: 10/093,250

(22) Filed: Mar. 6, 2002

(51) Int. Cl.[7] ..... E05C 9/12

(52) U.S. Cl. ..... 292/56; 292/DIG. 43; 292/11

(58) Field of Search ..... 292/11, 56, 31, 292/DIG. 43, 116, 120

(56) References Cited

U.S. PATENT DOCUMENTS

| | | | | | |
|---|---|---|---|---|---|
| 2,246,794 A | * | 6/1941 | Dall | 292/11 |
| 2,256,465 A | | 9/1941 | Brubaker | 292/25 |
| 3,236,551 A | * | 2/1966 | Nash | 292/11 |
| 3,239,260 A | * | 3/1966 | Beckman | 292/11 |
| 3,392,557 A | | 7/1968 | Solow | 70/240 |
| 3,630,557 A | * | 12/1971 | Pierce | 292/45 |
| 4,054,309 A | | 10/1977 | Borlinghaus | 292/216 |
| 4,111,473 A | | 9/1978 | Bourrie et al. | 292/126 |
| 4,441,345 A | | 4/1984 | Guarr | 70/240 |
| 4,763,934 A | | 8/1988 | Kaveney, Jr. | 292/21 |
| 5,066,055 A | | 11/1991 | Saitoh et al. | 292/228 |
| 6,014,876 A | | 1/2000 | Taylor | 70/240 |

* cited by examiner

*Primary Examiner*—Gary Estremsky
(74) *Attorney, Agent, or Firm*—Westman, Champlin & Kelly, P.A.

(57) ABSTRACT

A two-stage latch is used for a tailgate on a vehicle such as an excavator or skid steer loader. The tailgate forms a cover for an engine compartment or other components of the vehicle, and the two-stage latch has a primary latch dog that will hold the cover fully closed. A secondary catch hook is used and includes a lost motion drive for actuating the latch dog. When opening the tailgate the latch hook engages a retainer bracket and will remain in a holding position so that the cover or tailgate will open slightly when the latch hook is released but cannot be fully opened until the catch hook is manually released from the retainer bracket on the vehicle frame.

14 Claims, 6 Drawing Sheets

TWO STAGE LATCH FOR HEAVY DUTY ENGINE COVER

CROSS REFERENCE TO RELATED APPLICATION

Reference is made to U.S. patent application Ser. No. 09/576,459, filed May 23, 2000, the content of which is hereby incorporated by reference in its entirety.

BACKGROUND OF THE INVENTION

The present invention relates to a latch that is used on a heavy engine compartment cover or tailgate, such as on an excavator or a skid steer loader, that permits alignment of the latching parts and has a primary latch that holds the tailgate closed tightly. When the primary latch is released, a secondary catch will hold the cover or tailgate from opening completely until further deliberate movement of a manual actuator tab. Interfitting parts align the latch connections as well.

It has long been known to utilize a two-stage latch on the hoods of the engine compartments for automobiles. However, these usually require a separate manual actuation from inside the automobile, and a further movement of a latch dog or assembly from the exterior, before the hood can be fully opened. The hood does have a two-position opening, or in other words, a primary latch that holds the hood secured, which is released from the interior of the automobile, and a secondary hook or catch will hold the hood from opening completely. The initial movement is enough to permit access to a manually operated lever to release the secondary catch so that the hood can be opened.

In vehicles that have a vertically hinged cover that swings away from an engine compartment, such as on a skid steer loader, or a mini-excavator, a single-stage latch is presently used. Because these heavy engine covers are hinged to one side of the cover, about a vertical axis, the weight of the cover can cause slight misalignment due to tolerances in the manufacturing, or due to wear, and sometimes lifting the free edge of the door slightly is necessary in order to permit the latch parts to align.

It is also desirable to have a separate key lock on the latch so that the engine compartment can be secured when the equipment is not in use.

SUMMARY OF THE INVENTION

The present invention relates to a latch assembly for a tailgate or engine compartment cover that is hinged on one edge, and has a free edge that when closed is latched to a framework or body of a vehicle, as shown a power operated working vehicle such as an excavator or skid steer loader. In the form disclosed, the cover forms a tailgate for the vehicle, as well as an engine cover. The free edge is held with a latch construction that has aligning members on the tailgate and on the frame or body of the vehicle, and provides for a two-stage opening.

The two-stage opening is such that upon release of a key lock (if the key lock is in a locked position) and initial movement of a manual latch release lever, a primary latch will be released. The primary latch holds the cover or tailgate in its tightly closed position, and once this primary latch is released, a secondary catch, which permits a limited opening movement of the free edge of the tailgate, will remain in place unless the latch release lever is manually moved to the full extent of its travel. This permits an initial release of the latch without permitting a full opening of the tailgate, as a feature that ensures the tailgate will open only when it is desired. This avoids a situation where an unintentional load on the latch, or some external force, will cause the primary catch to release. The tailgate will be held from full opening by the secondary catch to avoid the tailgate from swinging to a full open position.

In the preferred form, for the preferred vehicle, the hinge axis is substantially vertical, and is to one side of the tailgate. This means that the free edge of the tailgate has a substantial cantilevered length from its support axis. The center of gravity of the tailgate acts on a lever arm from the hinge axis, and will tend to cause any tolerances in the hinge, or any wear that might occur in the hinge, to result in a vertical shifting of the free edge of the tailgate. This vertical shifting is accommodated by an alignment device on the tailgate latch assembly that guides the tailgate into position as the parts latch.

DETAILED DESCRIPTION OF THE ILLUSTRATIVE EMBODIMENTS

Figure 1:
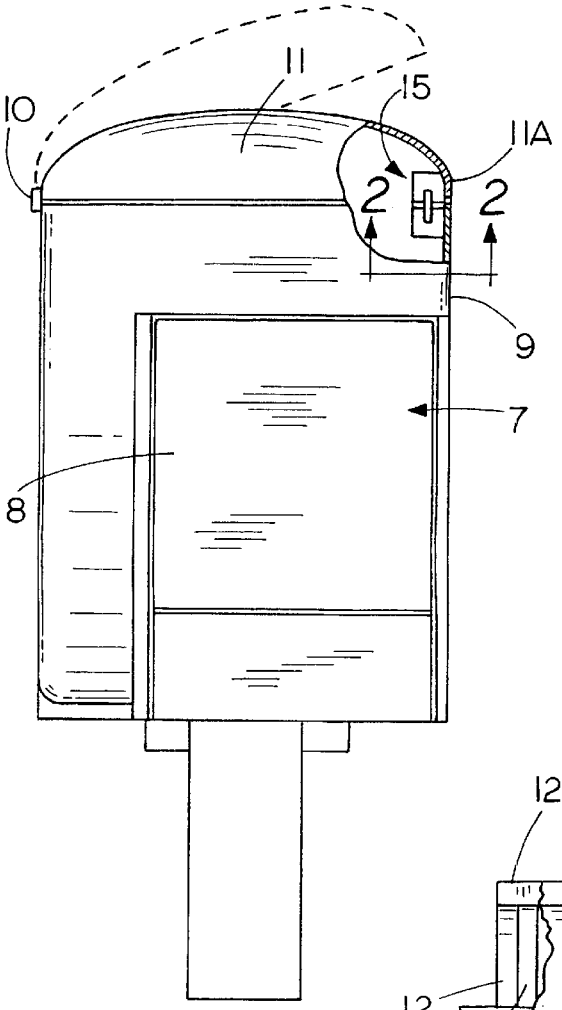
FIG. 1 is a schematic top view of a typical cab having a tailgate using a latch assembly made according to the present invention.

In FIG. 1, a powered vehicle, such as a mini excavator 7 is schematically illustrated in a top view. The excavator 7 has a cab 8, and a frame 9. A hinge 10 is provided along one edge of a tailgate 11. Hinge 10 is a vertical axis hinge, and is on one side of the excavator and tailgate, so that a free edge 11A of the tailgate will swing outwardly as indicated by the arrow in FIG. 1, to provide access to an engine compartment on the frame 9.

Figure 3:
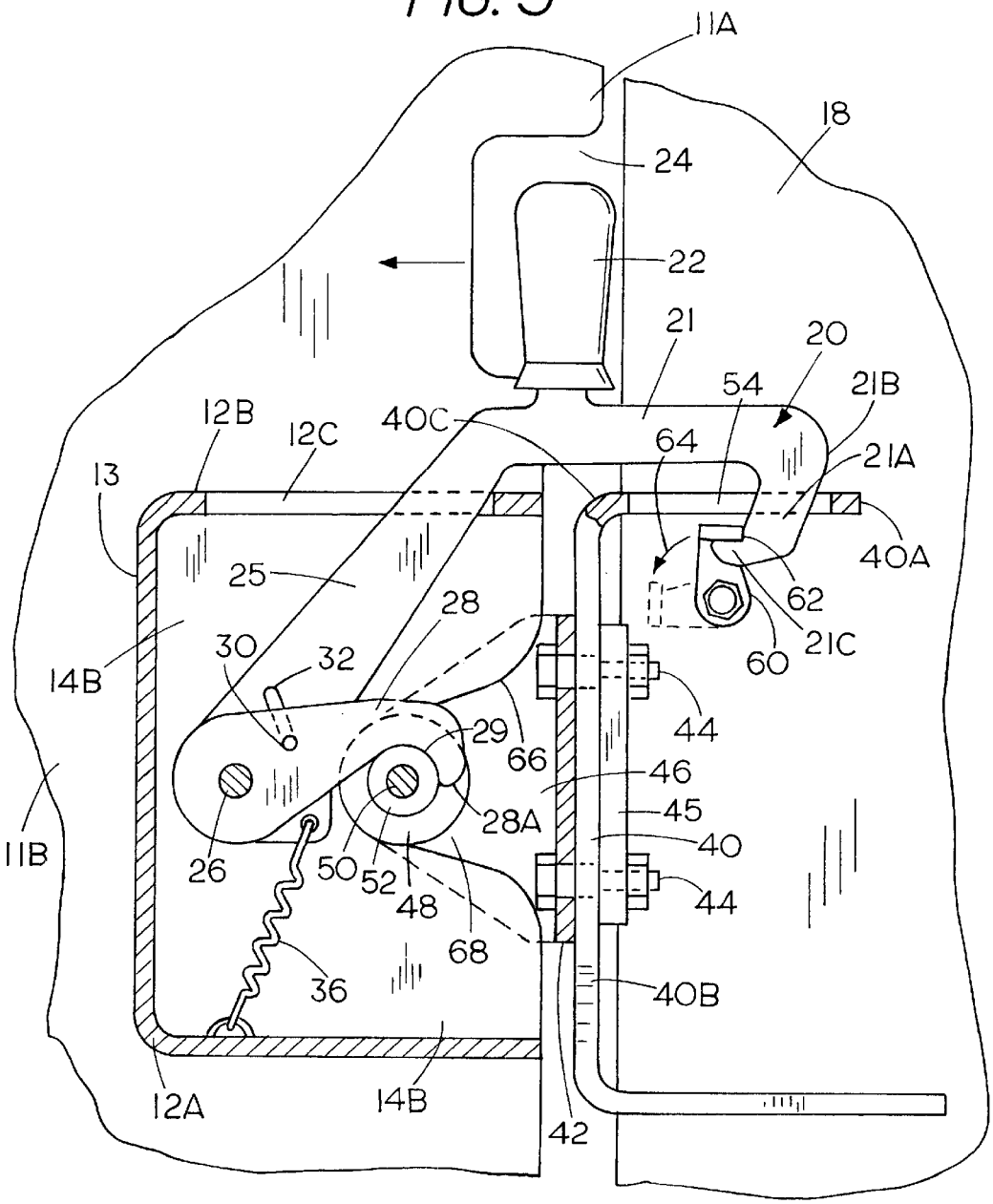
FIG. 3 is a side elevational view of the latch assembly of the present invention shown in a fully latched position.
Figure 4:
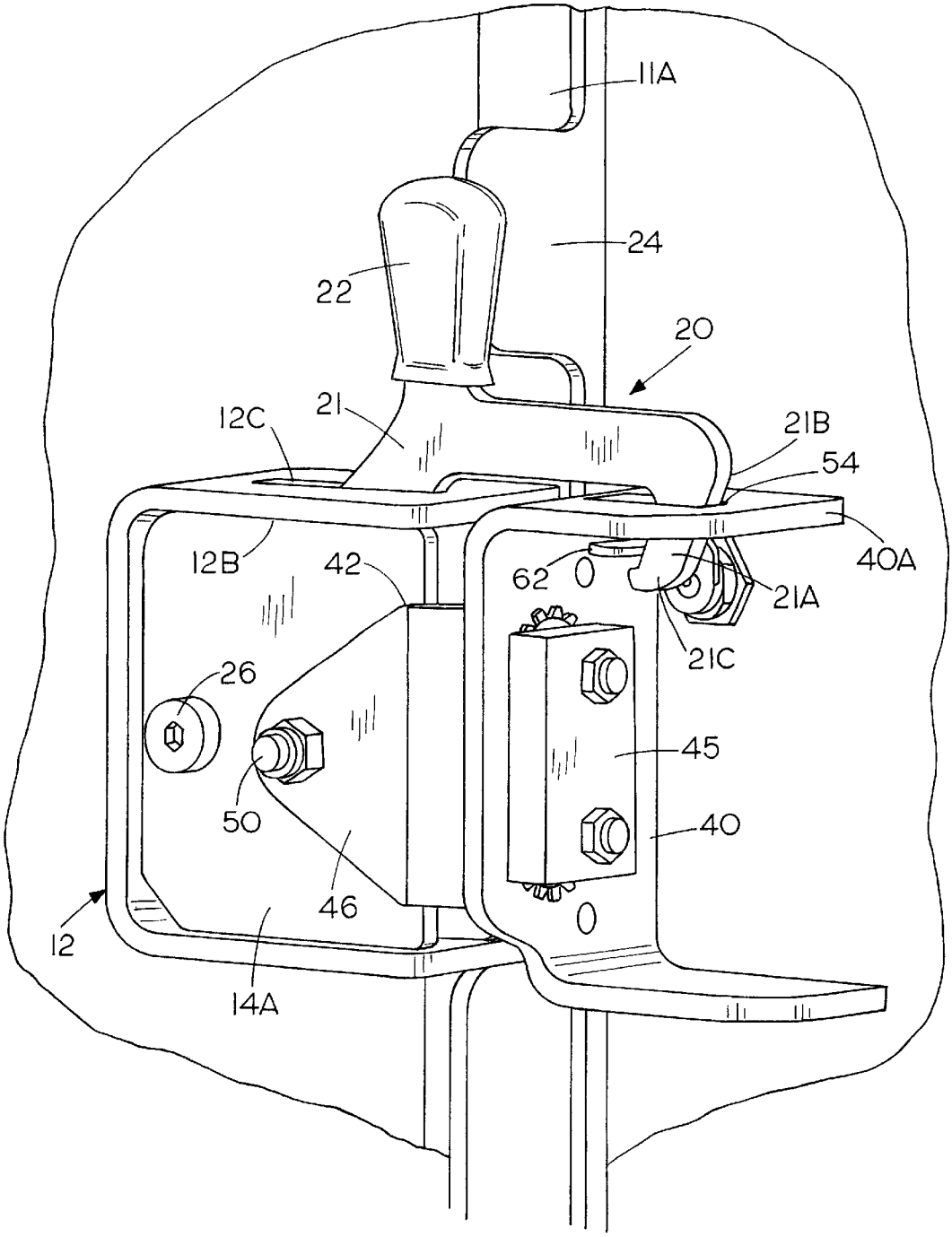
FIG. 4 is a perspective view of the latch assembly of the present invention shown in its fully latched and locked position.
Figure 5:
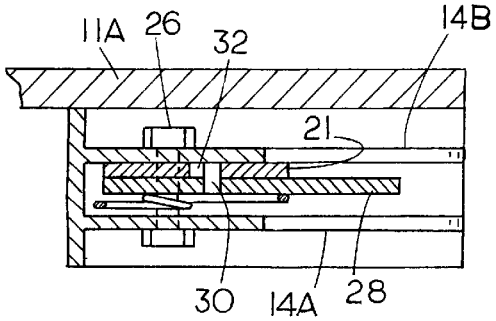
FIG. 5 is a fragmentary sectional view taken as on line 5—5 in FIG. 3.
Figure 7:
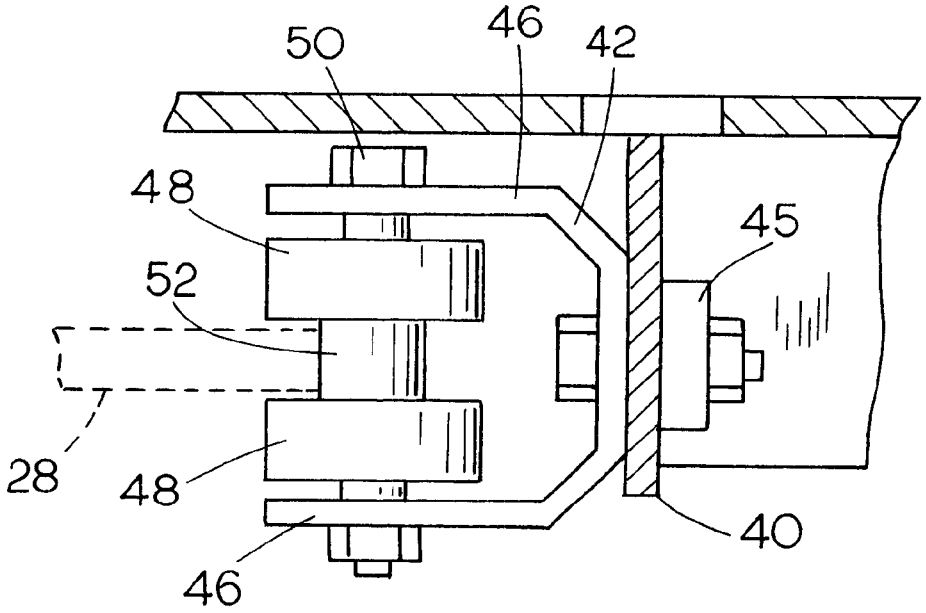
FIG. 7 is a plan view of a primary latch receiver taken on line 7—7 in FIG. 6.

A latch assembly 15 is made up with one part on the tailgate and a mating part on the frame. One part of the assembly is a first latch hook carrier 12, that is mounted on the tailgate and comprises a U-shaped bracket 12A with a pair of parallel walls 14A and 14B extending between upper and lower flanges or legs 12B and 12D of the bracket 12A. See for example, FIGS. 4, 5 and 7. The view in FIG. 7, is looking from the inside of the tailgate 11 outwardly. FIG. 3 is oriented in that same manner. The bracket upper leg 12B has a slot 12C defined therein that extends in fore and aft direction. Bracket 12A is welded to the side wall 11B of the tailgate 11, adjacent the free edge 11A. It can be seen that the free edge 11A will swing out or away from the side wall or panel 18 of the frame.

A latch hook assembly 20 is pivotally mounted on a pivot pin or bolt 26 between the vertical plates 14A and 14B on the bracket 12A. The latch hook assembly includes a catch hook 21 that extends up through the slot 12C. The catch hook 21 is formed with a manual actuating tab 22 that is above the leg 12B of the bracket 12A, and it is aligned with a recess or finger opening 24 defined in the edge of the side wall 11B of the tailgate 11. This means that the tab 22 is accessible from the exterior of the tailgate. Catch hook 21 has a base arm 25 that is pivotally mounted between the plates 14A and 14B on the pivot pin or bolt 26. The pivot pin or bolt 26 has a center shank portion that forms the pivot pin.

Figure 6:
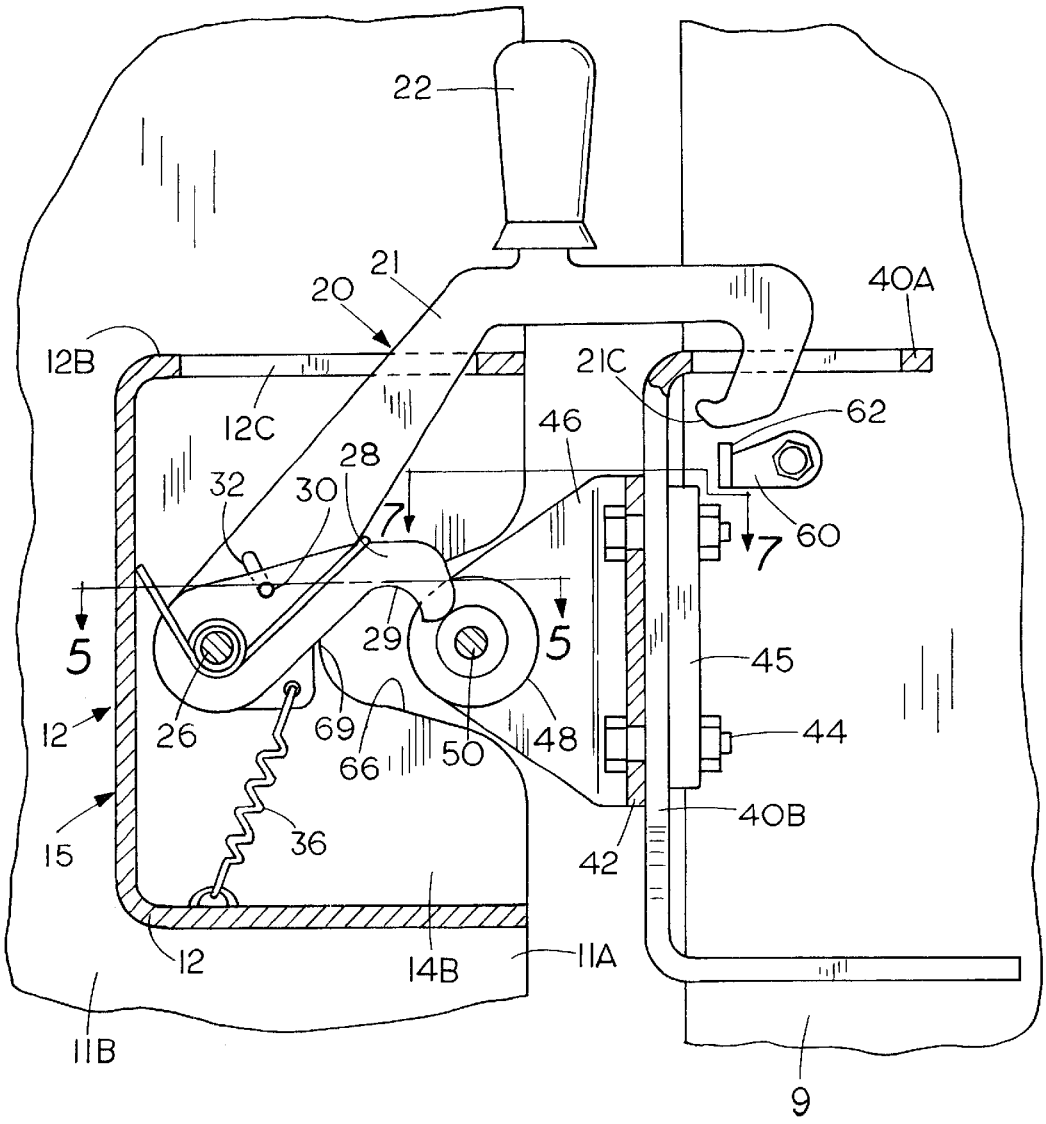
FIG. 6 is a side elevational view of the latch assembly of the present invention shown in a partially released position with a second-stage catch holding the cover or tailgate from swinging to a full open position.

A primary latch dog 28 is pivotally mounted on the same pivot pin or bolt 26 as the arm 25 of catch hook 21. The primary latch dog has a recess 29 at an outer end thereof. Additionally, a pin 30 is fixed to the latch dog 28 and extends laterally, outwardly therefrom. The outwardly extending end of the pin 30 slides in a slot 32 in the catch hook base arm 25. A torsion spring 34 is provided to urge the primary latch dog 28 in a clockwise direction, as shown in FIGS. 6 and 7.

Figure 8:
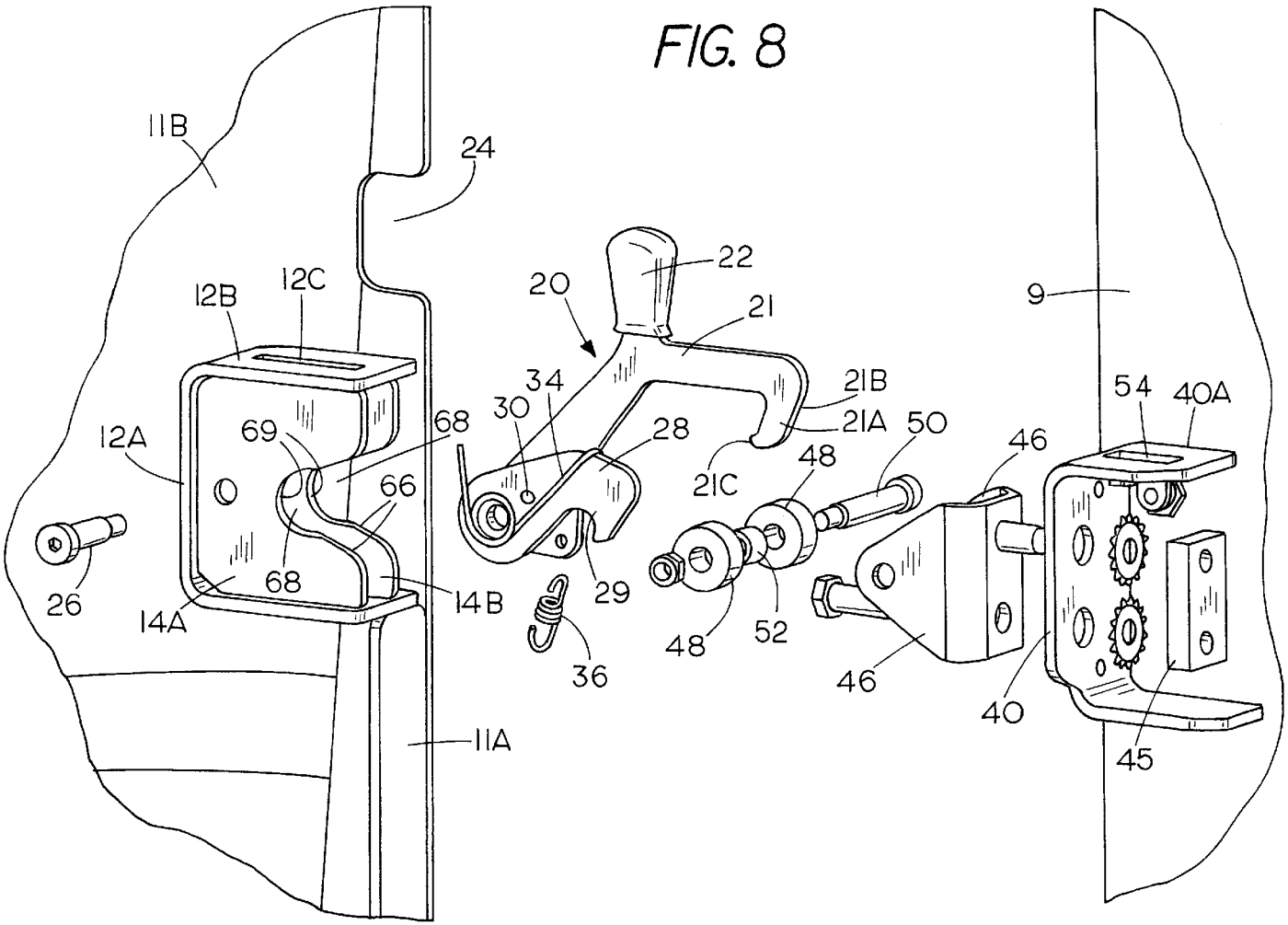
FIG. 8 is an exploded view of the latch assembly of the present invention.

A tension spring 36 is connected to an aperture in the lower end of the base arm 24 of the catch hook 21, and will urge this catch hook 21 in clockwise direction as shown in FIG. 8. The catch hook 21 is called a secondary catch.

Side wall 18 of the excavator frame mounts a catch bracket 40 which also is generally U-shaped, as shown, and it is welded to the frame or otherwise secured to the frame so that it remains with the frame of the implement. The bracket 40 is the mating part of the latch assembly 15 which mates with the parts on the tailgate. The bracket 40 has a housing 42 secured thereon with a pair of bolts 44 which extend through an opening in a block 45 welded to an upright portion of the bracket 40.

The housing 42 forms a latch dog receiver, and has a pair of side arms or walls 46. (See FIGS. 7 and 8). A pin 50 extends between the walls 46 and supports a latch retainer sleeve 52 held between rollers 48 that form spacers that hold the sleeve 52 centered between walls 46. The rollers 48 are also mounted on the pin or bolt 50. The sleeve 52 forms a latch retainer for the primary latch dog. The latch dog receptacle 29 will fit over this latch retainer sleeve 52 when the tailgate 11 is closed fully.

Bracket 40 includes a vertical wall 40B and an upper leg 40A. The upper leg 40A and the secondary catch hook 21 has a hook portion 20A that will extend through this slot 54 when the tailgate is moved toward its closed position. The catch hook portion 20A has an inclined leading surface 20B which will ride over a rounded corner 40C between the top leg 40A of the bracket 40 and its vertical wall 40B as the catch hook 20 pivots against the action of the spring 36. The tailgate 11 moves from an open position wherein the catch hook 20 is released from the bracket 40, to its closed position shown in FIG. 3, for example.

Figure 2:
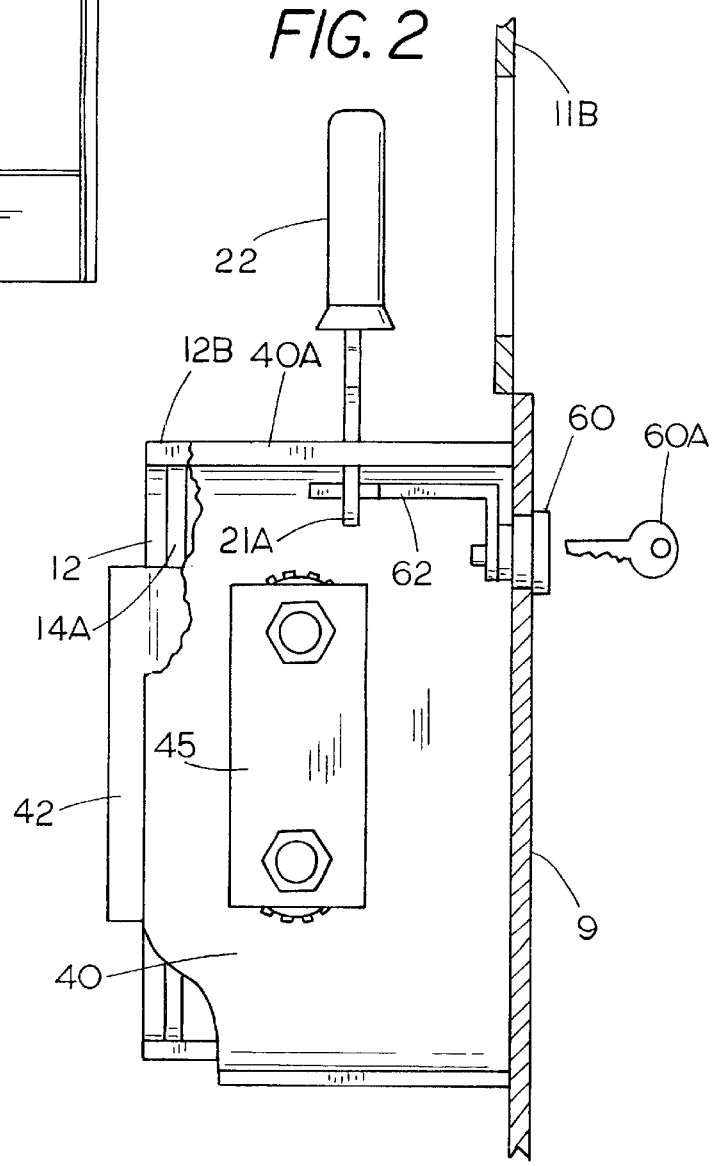
FIG. 2 is a front sectional view taken on line 2—2 in FIG. 1.

A key lock 60 is mounted on the side wall 18 of the frame, and is accessible from the exterior of the side wall with a key 60A (see FIG. 2). The key can be used for rotating an inner portion of the lock, as is commonly done, and a lock dog 62 on the rotatable portion of the lock is in position to overlie a lock lip 21C of the hook portion 21A of the catch hook 21 when the lock dog is in its locked position as shown in FIG. 3.

The lock dog 6 can be moved to a released position shown in FIG. 6, to permit the hook portion 21A to move upwardly relative to the top leg 40A of the bracket 40. When the lock dog 62 has been moved in a counter clockwise direction indicated by the arrow at 64 in FIG. 3 to its released position shown in FIG. 6, then the latch dog 28 can be released by moving the tab 22 to pivot the catch hook 21 upwardly. As the catch hook 21 is pivoted initially, the pin 30, which is at the end of the slot 32 as shown, will lift the latch dog 28 off the rounded surface of the latch dog retainer sleeve 52 so that the outer tip 28A of the latch dog 28 will clear the latch retainer 52, and the tailgate can be partially opened. In this first stage, the catch hook portion 21A will remain in the slot 54 in the top leg 40A of the bracket 40 and this will prevent the tailgate from moving to an opened position until the tab 22 has been moved sufficiently far to lift the catch hook portion 21A, and the lock lip 21C out of the slot 54 to clear the bracket 40. After the catch hook is lifted to clear the leg 40A, the tailgate 11 can be pivoted to its full open position.

This means that the secondary catch hook 21 provides a secondary catch that will prevent the tailgate 11 from being opened unless the catch hook 21 is manually pushed a substantial distance to lift the hook portion 21A out of the slot 54 and clear the bracket 40. This ensures that if the latch dog 28 releases, or if the tailgate is not latched tightly initially, the tailgate will not swing open and cause damage to any component of the tailgate because the catch hook will hold it in a secondary position that will prevent a full open swinging of the tailgate 11.

When the tailgate is again moved from an open position to a closed position, the surface 21B of the catch hook will first strike the rounded corner 40C of the bracket 40, and the catch hook 21 will lift against the load of the spring 36 so that the end 21C forming the lock lip will ride along the upper surface of the leg 40A until the catch hook enters the slot 54.

The latch dog 28 also has a rounded outer or leading edge surface that will ride up over the rounded surface of the latch dog retainer sleeve 52, and when the tailgate is fully closed, the primary latch dog 28 will seat on the latch dog retainer 52 and will be held firmly in place. The spacer rollers 48 will be engaged by the tapered surfaces 66 of guide slots 68 on the plates 14A and 14B as the tailgate closes so the tailgate will be aligned properly for latching at the time the catch hook surface 21B engages the rounded surface 40C.

The rollers 48 seat in recesses 69 at the inner end of the guide slots 68. The inner end or recesses 69 of the slots are made to have a recess radius equal to or slightly larger than the radius of rollers 48 for proper seating of the tailgate, and alignment of the latching parts. The spacer rollers 48 roll easily along the tapered surfaces 66, either the upper or lower surfaces, to provide for the proper alignment of the tailgate.

The latch will be secured to hold the tailgate closed. The catch assembly 20, which includes both the primary and secondary latching members, is easily constructed, and provides a reliable latch that will permit a primary latch dog to be released without fully releasing the tailgate, and also combines the guiding surfaces for proper alignment of the parts as the tailgate is closed.

The pin 30 and slot 32 form a lost motion drive or link for the latch dog 28. When closing the tailgate, the catch hook 21 and catch portion 21A will enter the slot 59 before the latch dog engages the retainer sleeve, and as the tailgate closes the latch dog 28 pivots in counter clockwise direction (FIG. 3) and rides on retainer sleeve 52. Pin 30 slides in slot 32 as the latch dog pivots. This pivoting of the latch dog 28 is independent of movement of the catch hook 21. This permits two stage latching as the tailgate closes.

Although the present invention has been described with reference to preferred embodiments, workers skilled in the art will recognize that changes may be made in form and detail without departing from the spirit and scope of the invention.

What is claimed is:

1. A two-stage latch for a cover hingedly attached to a frame comprising a bracket supported on the frame and having a catch receiver and a latch retainer, a housing mounted on the cover, a catch hook pivotally mounted on the housing, a latch dog pivotally mounted on the housing coaxial with the catch hook, a lost motion drive between the catch hook and the latch dog that permits the latch dog to pivot in one direction relative to the catch hook, and to be pivoted by the catch hook when the catch hook is moved in an opposite direction, a spring urging the latch dog in the one direction to form a primary latch with the latch retainer when the cover is closed, the catch hook engaging the catch receiver before the latch dog engages the latch retainer when the cover is moved toward a closed position, the catch hook holding the cover from opening, the lost motion drive permitting the latch dog to be moved away from the latch retainer to release the latch dog while the catch hook remains in the catch receiver to permit limited opening movement of the cover only until the catch hook is manually moved farther in the same direction as the direction the catch hook is moved to release the latch dog.

2. The two-stage latch of claim 1, wherein the latch retainer comprises a rounded surface, and the latch dog has a hook portion that hooks over the rounded surface.

3. The two-stage latch of claim 1, wherein the lost motion drive comprises a slot on the catch hook, and a pin on the latch dog extending to be positioned in the slot, the slot having an end surface that engages the pin and moves the latch dog when the catch hook is pivoted in the one direction, and the slot being oriented so the latch dog may pivot in the one direction independently of the catch hook.

4. The two-stage latch of claim 1, and a spring for urging the catch hook in a direction opposite from the one direction.

5. The two-stage latch of claim 1, wherein the catch receiver and the latch dog retainer are both mounted on the bracket, the bracket including at least one roller facing the cover, and the housing on the cover having a recess opening in direction toward the bracket and having surfaces that taper toward a seat in a base of the recess, said recess receiving the at least one roller as the cover is closed for providing alignment of the cover and the frame.

6. The two-stage latch of claim 1, and a key lock bracket moveable for engaging the catch hook when the cover is closed to prevent the catch hook from being pivoted in the one direction to pivot the latch dog sufficiently to disengage the latch dog from the latch retainer when the key lock is in a locked position.

7. The two-stage latch of claim 1, wherein said housing comprises a pair of substantially parallel plates fixed relative to the cover, the catch hook and the latch dog being mounted between the parallel plates.

8. The two-stage latch of claim 7, wherein said parallel plates have recesses therein facing the frame, the recesses each having an inner roller seat, and the recesses being defined by tapered surfaces widening out in a direction toward the frame from the inner roller seat, the bracket on the frame mounting a pair of rollers, said rollers being positioned to engage the tapered surfaces and align the cover as the cover is moved to a closed position, the rollers seating in the roller seats when the cover is closed and the primary latch dog is seated on the latch retainer.

9. The two-stage latch of claim 8, wherein the latch retainer is positioned between the rollers.

10. A two-stage latch for a vehicle tailgate hingedly attached to a vehicle frame comprising a lock bracket supported on the vehicle frame and having a catch receiver and a latch dog retainer, a housing mounted on the tailgate, a catch hook pivotally mounted on the housing on the tailgate, a latch dog pivotally mounted on the housing coaxial with the catch hook, a drive pin on the latch dog extending laterally from the latch dog, the catch hook having a slot for receiving the pin and positioned so the pin rests in one end of the slot and the latch dog can pivot in one direction relative to the catch hook, and is driven by movement of the catch hook in the one direction, the latch dog and catch hook each being independently urged in direction opposite from the one direction, the latch dog forming a primary latch with the latch dog retainer when the cover is closed, the catch hook engaging the catch receiver before the latch dog engages the latch dog retainer when the cover is moved toward a closed position, the catch receiver permitting sliding movement of the catch hook as the cover closes, the pin moving in the slot permitting the latch dog to be moved away from the latch dog retainer upon an initial movement of the latch hook in the one direction to release the latch dog while the catch hook remains in the catch receiver to prevent opening of the cover until the catch hook is manually moved farther in the one direction than the initial movement.

11. The two-stage latch of claim 10, wherein the latch retainer comprises a rounded surface, and the latch dog has a hook portion that hooks over the rounded surface.

12. The two-stage latch of claim 10, wherein the lock bracket has a pair of rollers on a side of the lock bracket adjacent to the cover, and the housing on the cover having a recess defined by tapered surfaces for guiding the rollers as the cover is closed for providing alignment of the cover and the frame.

13. The two-stage latch of claim 10, and a key lock bracket for engaging the catch hook when the cover is closed to prevent the catch hook from being pivoted in the one direction and lifting the latch dog when the key lock is in a locked position.

14. The two-stage latch of claim 10, wherein said housing comprises a pair of substantially parallel plates fixed relative to the cover, a pivot pin extending between the parallel plates, the catch hook and the latch dog being mounted on the pivot pin between the parallel plates.

* * * * *

UNITED STATES PATENT AND TRADEMARK OFFICE

CERTIFICATE OF CORRECTION

PATENT NO. : 6,616,199 B1
DATED : September 9, 2003
INVENTOR(S) : Tokach et al.

It is certified that error appears in the above-identified patent and that said Letters Patent is hereby corrected as shown below:

Title page,
Item [73], Assignee, cancel "Bobcat Company" and insert -- Clark Equipment Company --.

Signed and Sealed this

Thirteenth Day of July, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,616,199 B1
DATED : September 9, 2003
INVENTOR(S) : Tokach et al.

It is certified that error appears in the above-identified patent and that said Letters Patent is hereby corrected as shown below:

Title page,
Item [73], Assignee, cancel "Bobcat Company" and insert -- Clark Equipment Company --.

Signed and Sealed this

Third Day of August, 2004

JON W. DUDAS
*Acting Director of the United States Patent and Trademark Office*